US007371508B2

(12) United States Patent
Toyoda et al.

(10) Patent No.: US 7,371,508 B2
(45) **Date of Patent: *May 13, 2008**

(54) PLASMA DISPLAY PANEL AND METHOD FOR FABRICATING THE SAME

(75) Inventors: Osamu Toyoda, Kawasaki (JP); Akira Tokai, Kawasaki (JP); Kazunori Inoue, Kawasaki (JP); Fumihiro Namiki, Kawasaki (JP); Saburou Morita, Kawasaki (JP); Yojiro Shimada, Kawasaki (JP); Hitoshi Hirakawa, Kawasaki (JP); Takashi Katayama, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 171 days.

This patent is subject to a terminal disclaimer.

(21) Appl. No.: 10/810,661

(22) Filed: Mar. 29, 2004

(65) Prior Publication Data

US 2004/0234902 A1 Nov. 25, 2004

Related U.S. Application Data

(63) Continuation of application No. 09/763,572, filed as application No. PCT/JP99/04141 on Jul. 30, 1999, now Pat. No. 6,713,959.

(30) Foreign Application Priority Data

Aug. 28, 1998 (JP) ..... 10(1998)-243337
Oct. 20, 1998 (JP) ..... 10(1998)-298399

(51) Int. Cl.
*H01J 9/227* (2006.01)

(52) U.S. Cl. ..... 430/321; 445/24

(58) Field of Classification Search ..... None
See application file for complete search history.

(56) References Cited

U.S. PATENT DOCUMENTS 5,209,688 A * 5/1993 Nishigaki et al. ..... 445/24
5,909,083 A * 6/1999 Asano et al. ..... 313/584
6,008,582 A 12/1999 Asano et al.
6,249,264 B1 6/2001 Sano et al.
6,713,959 B1 * 3/2004 Toyoda et al. ..... 313/582

FOREIGN PATENT DOCUMENTS

JP 63-155528 6/1988
JP 63-232238 9/1988
JP 3-101035 4/1991

(Continued)

*Primary Examiner*—John A. McPherson
(74) *Attorney, Agent, or Firm*—Staas & Halsey LLP

(57) ABSTRACT

A plasma display panel in which projections are formed in grooves between partitions and phosphor layers are provided on the projections so as to increase the area where phosphor adheres and thereby to increase the luminance. A couple of substrates are opposed to each other to form a discharge space. Band-like partitions partitioning the discharge space are arranged on the back or front substrate. Wall-like projections lower than the partitions and high enough to increase the area where phosphor layers are formed are provided in the region where the discharge space is formed in the long grooves between the partitions or around the discharge space. Phosphor layers are formed in the grooves between the partitions including the wall-like projections. A method for producing such a plasma display panel is also disclosed.

7 Claims, 12 Drawing Sheets

FOREIGN PATENT DOCUMENTS

| | | | |
|---|---|---|---|
| JP | 3-179636 | | 8/1991 |
| JP | 4-47639 | | 2/1992 |
| JP | 5-41165 | | 2/1993 |
| JP | 6-275202 | | 9/1994 |
| JP | 7-045191 A | * | 2/1995 |
| JP | 9-69335 | | 3/1997 |
| JP | 9-306345 | | 11/1997 |
| JP | 10-308178 | | 11/1998 |
| JP | 10-321148 | | 12/1998 |
| JP | 11-204043 | | 7/1999 |
| JP | 11-213896 | | 8/1999 |
| JP | 11-260264 | | 9/1999 |

* cited by examiner

PLASMA DISPLAY PANEL AND METHOD FOR FABRICATING THE SAME

This application is a continuation of application Ser. No. 09/763,572, filed Feb. 26, 2001, now allowed, which is scheduled to issue as U.S. Pat. No. 6,713,959 on Mar. 30, 2004.

FIELD OF THE INVENTION

The present invention relates to a plasma display panel (PDP) and a method for fabricating the same. More particularly, the present invention relates to a plasma display panel where fluorescent layers are formed in a discharge space partitioned by barrier ribs and a method for fabricating the same.

BACKGROUND OF THE INVENTION

A PDP has been given attention as a display panel (low-profile display device) which exhibits an excellent visibility, and its development has been pursued to a high-definition display and a large screen display to foster its versatility in the field of high-definition display in Japan or the like.

The PDP is broadly classified as an AC-driven type or a DC-driven type, or as a surface discharge type or an opposite discharge type. Currently, an AC-driven surface discharge PDP constitutes the mainstream in industry because of its potential high-definition display, large screen display and convenience of production.

The PDP is a self-luminous display panel which structurally has a discharge space defined by a pair of substrates (typically, glass substrates) spaced a minute distance in an opposing relation with the periphery thereof being sealed.

The PDP includes ribs provided equidistantly for partitioning the discharge space. The ribs prevent interference of discharge and color cross-talk.

For example, a PDP of an AC-driven three-electrode surface discharge type suitable for fluorescent color display includes band-like ribs having a height of about 100 μm to about 200 μm provided parallel to and equidistantly from each other along data electrode (address electrode) lines. A front substrate to be combined with an opposing rear substrate having ribs thereon includes display electrode pairs (sustain electrode pairs) for generating main discharge. The display electrode pairs are arranged parallel to each other in a direction crossing the ribs.

Fluorescent layers are formed in elongated grooves between the ribs to convert light by discharge across the display electrode pairs into visible light, thereby achieving display. Therefore, display luminance of the PDP is dependent on strength of discharge, density of fluorescent substances in the fluorescent layers, surface areas of the fluorescent layers, types of the fluorescent substances, reflectance of the rear surface of the fluorescent layers.

In the PDP thus constructed, separation of pixels (discharge regions) in the direction of the display electrodes is made by the ribs whereas the separation of the pixels (discharge regions) in the direction crossing the display electrodes, i.e., in a longitudinal direction of the ribs, is made by narrowing an inter-electrode spacing for generating discharge (referred to as discharge slits or slits hereinafter) as compared with an inter-electrode spacing for generating no discharge (reverse slits), to limit discharge. Here, there rises a problem that the reverse slits, even if having fluorescent layers formed therein, make no contribution as the display areas.

Further, a typical challenge with the PDP as a self-luminous display device is to improve the luminance, or fundamentally, to improve luminous efficiency of fluorescent substances themselves. This challenge is currently dealt with by, for example, changing the shape and the amount of the fluorescent substances applied and by improving the reflectance of a rear surface material.

Therefore, a plasma display panel has been desired which is simply constructed but has further higher luminance than a conventional one.

SUMMARY OF THE INVENTION

The inventors of the present invention have found that the aforementioned challenges will readily be attained by providing wall-like projections in locations where the fluorescent layers are to be provided and forming the fluorescent layers so as to cover the wall-like projections, thereby increasing the area coated with the fluorescent substances and realizing a panel with increased luminance.

Thus, the present invention provides a plasma display panel provided with a pair of substrates disposed opposedly to form a discharge space therebetween, a plurality of band-like barrier ribs arranged in parallel on one of the substrates on a rear or front side to partition the discharge space, and fluorescent layers provided in elongated grooves between the barrier ribs, the plasma display panel being characterized in that wall-like projections which are lower in height than a relatively higher height of the barrier ribs and high enough to increase a formation area of the fluorescent layers are provided in the elongated grooves between the barrier ribs and the fluorescent layers are formed in the grooves including the wall-like projections between the barrier ribs. (As alternatively but equivalently expressed, the wall-like projection are ribs of a lower hight than the relatively higher height of the barrier ribs.)

Also, there is provided a method for fabricating a plasma display panel as described above, comprising: in the formation of the wall-like projections and the barrier ribs on one of the substrates on the rear or front side of the plasma display panel, forming a first photosensitive material layer on a substrate; disposing thereon a photolithographic mask having a pattern of the wall-like projections, followed by exposure; without development, forming a second photosensitive material layer on the first photosensitive material layer; disposing thereon a photolithographic mask having a pattern of the barrier ribs, followed by exposure and development, thereby producing a master having the wall-like projections and the barrier ribs formed on the substrate; and producing a transfer mold using the master, filling a barrier rib material in concaves of the transfer mold and transferring the barrier rib material onto the substrate for the plasma display panel; or producing a pressing mold using the master, pressing a barrier rib material on the substrate for the plasma display panel, thereby forming the wall-like projections and the barrier ribs.

DETAILED DESCRIPTION OF THE INVENTION

Figure 1:
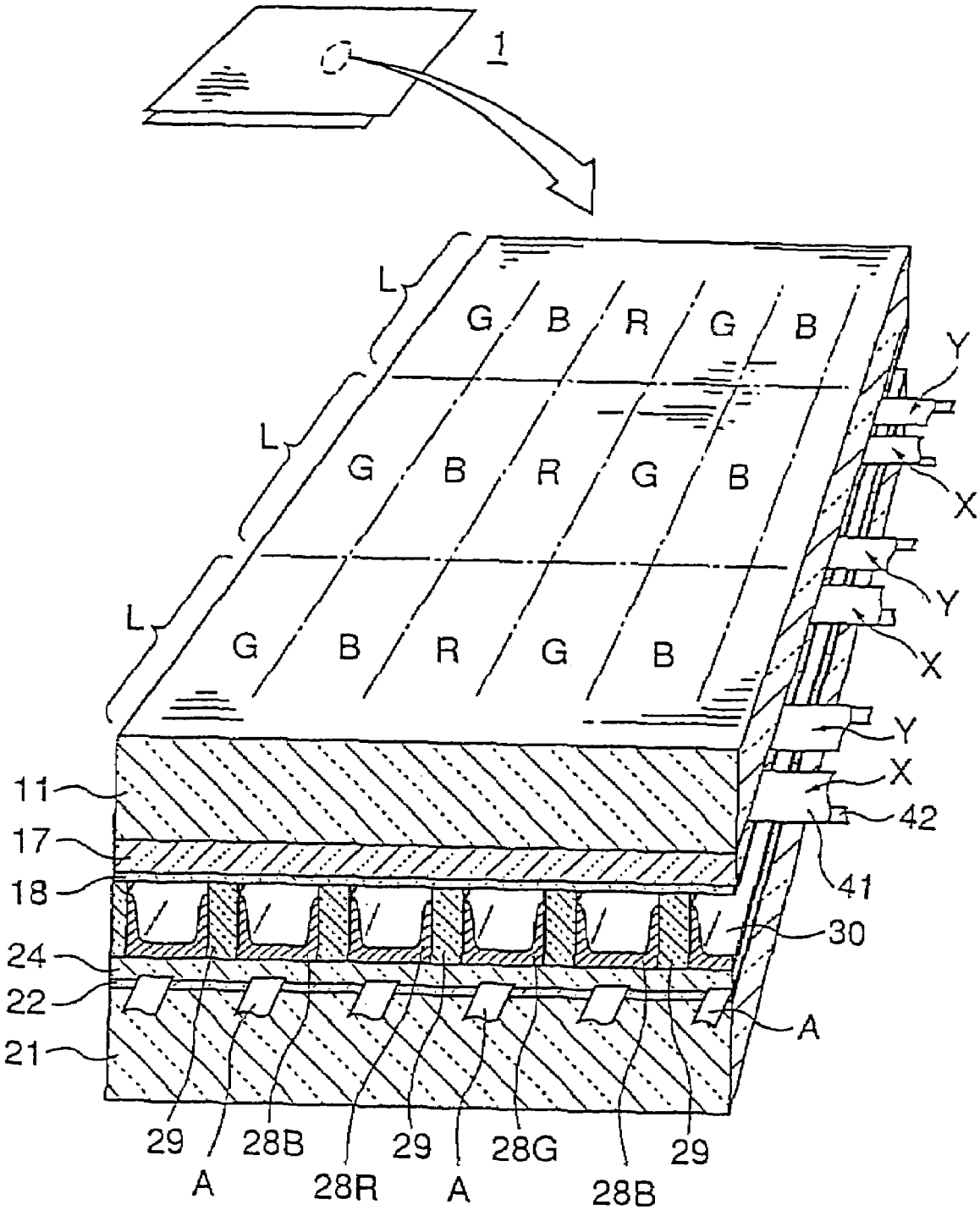
FIG. 1 is a perspective view illustrating the internal construction of an AC-driven type three-electrode surface discharge PDP according to an embodiment of the present invention.

As the front substrate and the rear substrate in the present invention, included is a glass substrate, a quartz substrate, a silicon substrate or the like substrate, or any of these substrate on which desired elements such as electrodes, a dielectric layer and a protection film are formed.

The band-like ribs may be ones in any configuration so far as they are formed on a rear substrate or a front substrate. For example, they may be ribs in stripes arranged parallel to each other or may be ribs in a meander configuration arranged parallel to each other (see Japanese Unexamined Patent Publication No. Hei 9(1997)-050768). Further, ribs of all configurations may be mentioned such as ribs whose end portions are wider than central portions or band-like ribs whose end portions are interconnected to each other.

Sealing of the peripheries of the front substrate and the rear substrate is not particularly limited, and any material and any method can be employed.

The wall-like projections may have any shape so far as they are lower than ribs and high enough to attain the purpose of increasing the area where fluorescent layers are formed. In other words, materials and methods for the projections are not particularly limited so far as the projections are formed, in elongated grooves between the ribs which are regions where the fluorescent layers are to be formed, in wall-like shape lower than the ribs so as not to prevent circulation of gas, which is one of characteristics of the band-like ribs. For example, if the ribs are arranged in stripes, the projections may be formed continuously or interruptedly in the direction crossing the ribs or in a direction parallel to the ribs.

Specifically, if the ribs are arranged parallel to each other in stripes, the wall-like projections may be provided in the direction crossing the ribs.

In this case, where an opposing substrate is constructed to have a plurality of main electrode pairs for a surface discharge in the direction crossing the ribs, the wall-like projections may be provided in locations corresponding to non-discharge regions (reverse slits) between adjacent main electrode pairs. This construction enables discharge coupling (cross-talk) between the adjacent main electrode pairs to be prevented.

Alternatively, the wall-like projections may be provided in locations corresponding to discharge regions defined by the main electrode pairs.

Further, if the ribs are arranged parallel to each other in stripes, the wall-like projections may be provided in stripes in parallel to the ribs.

Further, if the ribs are arranged parallel to each other in stripes, the wall-like projections may comprise first projections provided in a direction crossing the barrier ribs and second projections provided parallel to the barrier ribs. In this case, the first projections are desirably formed in the locations corresponding to the non-discharge regions, i.e., the reverse slits as mentioned above.

So far as the fluorescent layers are formed in the grooves between the ribs, materials and methods for the fluorescent layers are not particularly limited. Any known material and any known method may be used.

In the method for forming a plasma display panel according to the present invention, the first photosensitive material is not particularly limited, and any known material may be used such as a photosensitive resist or a photosensitive dry film.

So far as the photolithographic mask disposed on the first photosensitive material layer has a pattern for the wall-like projections, any material and method that are employed in a known photolithographic technique can be applied as they are. As for exposure, any exposure that is employed in the known photolithographic technique can be applied.

The second photosensitive material can be the same as or different from the first photosensitive material. So far as the photolithographic mask disposed on the second photosensitive layer has a pattern for the ribs, a material and a method that are employed in the known photolithographic technique can be applied as they are. As for exposure, any exposure that is employed in the known photolithographic technique can be applied.

The transfer mold can be formed by copying the master using a silicone rubber or the like. By performing transfer using the transfer mold, the wall-like projections and ribs are formed on a substrate for a PDP. In this case, the wall-like projections and the ribs are desirably transferred using the same rib material. The transfer of the rib material onto the substrate for a PDP can be carried out by a known transfer method. Further, the transfer mold may be produced as a pressing mold of a rigid resin or by electroforming. In this case, by pressing a dielectric substance with the pressing mold, the wall-like projections and the ribs can be formed on the substrate for the PDP.

The rib material to be used in the transfer or the pressing is not particularly limited and any known material can be used.

The master produced of the photosensitive material may be used as the master as it is or as an intermediate for repeated transfer with other resins or for production of a mold by electroforming.

According to the present invention, the fluorescent layers are formed in the grooves including the wall-like projections between the ribs. In the case where the projections are provided in boundary areas between discharge cells, however, the fluorescent layers are not necessarily required because the projections alone can prevent the interference of discharge between adjacent discharge cells without the fluorescent layers.

Further, according to the present invention, the material for the wall-like projections is desirably the same as the rib material or a material which has similar properties as those of the rib material.

However, the material for the wall-like projections is not limited thereto, and a material having properties different from those of the rib material can be used.

In this aspect, the present invention provides a plasma display panel, characterized by comprising: a pair of substrates disposed opposedly to form a discharge space therebetween, a plurality of barrier ribs in stripes arranged in parallel on either one of the substrates to partition the discharge space, and wall-like projections lower than the barrier ribs provided in elongate grooves between the barrier ribs.

According to the present invention in this aspect of the present invention, the projections are provided in the boundary areas (reverse slits) between a plurality of discharge cells formed in the elongate grooves between the ribs arranged in stripes on one of the substrates. Accordingly, the interference of discharge between adjacent discharge cells can be prevented, and discharge light can be reflected by the projections to be effectively utilized to thereby improve luminescent efficiency. Moreover, since the projections are lower than the ribs, circulation is not prevented between the ribs in stripes, during discharge of impurity gas and during introduction of discharge gas.

In the present invention in this aspect, the ribs may be formed of, for example, a known paste-form rib material prepared by mixing a low-melting point glass powder, a resin and a solvent, by a known method such as a screen printing method, a sandblasting method and an embedding method. The low-melting point glass may be, for example, a glass containing $PbO—B_2O_3—SiO_2$.

The projections can be formed of the same material as the fluorescent layer material, the same material as the rib material, the same material as the dielectric layer material or the like. Also, the projections may be formed using a white pigment or the like which is used for coloring the ribs white. In the case of using the same material as the rib material, it is desired to use the above-mentioned glass containing $PbO—B_2O_3—SiO_2$.

The projections are lower than the ribs and high enough to prevent discharge coupling between adjacent discharge cells. In this sense, the height of the projections is one fourth or three fourths of the ribs, and desirably is about half of the ribs.

The fluorescent layers may be formed to cover the projections in the elongate grooves between the ribs. In this case, if surfaces of the projections are formed to be light-reflective faces before the formation of the fluorescent layers, light emitted from the fluorescent layers formed on the projections can be reflected to thereby enhance the luminance.

The present invention will now be explained in detail based on embodiments shown in the drawings. It should be understood that the present invention is not limited to the embodiments.

FIG. 1 is a perspective view illustrating the internal structure of an AC-driven type three-electrode surface discharge PDP according to an embodiment of the present invention.

In a PDP 1, a pair of sustain electrodes (display electrodes) X and Y is provided on every line L on an interior surface of a front glass substrate 11. Line L is a row of cells in the horizontal direction on the screen. The sustain electrodes X and Y are each formed of a transparent conductive film 41 of ITO and a metal film (bus electrode) 42 of Cr—Cu—Cr, and are covered with a dielectric layer 17 of a low-melting point glass having a thickness of about 30 μm. A protection film 18 of magnesium oxide (MgO) having a thickness of several thousands angstroms is provided on the surface of the dielectric film 17. Address electrodes A are arranged on an underlying layer 22 which covers an interior surface of a rear glass substrate 21, and are covered with a dielectric layer 24 having a thickness of about 10 μm. Ribs 29 each having a linearly elongated shape in plan view and a height of 150 μm are provided between the respective address electrodes A. These ribs 29 partition an electric discharge space 30 on a subpixel-by-subpixel (unit luminous area) basis in the line direction and define the spacing of the electric discharge space 30. Fluorescent layers 28R, 28G and 28B of three colors R, G and B for color display are provided to cover interior surfaces of the rear substrate including surfaces above the address electrodes A and side surfaces of the ribs 29. The layout pattern of three colors is a stripe pattern in which cells in one column have the same luminescent color and adjacent columns have different luminescent colors. In the formation of the ribs, it is desirable that top portions of the ribs should be colored dark and the other portions thereof colored white for improvement of visible light reflectance, thereby enhancing contrast. Coloring is performed by adding a pigment of a predetermined color to a glass paste material.

The discharge space 30 is filled with a discharge gas of a mixture of xenon with neon as a main component (an enclosure pressure of 500 Torr), and the fluorescent layers 28R, 28G and 28B are locally excited by ultraviolet light emitted from xenon during electric discharge and emit light. Each pixel (picture element) for display is constituted by three subpixels juxtaposed in the line direction. A structural body within each subpixel is a cell (display element). The ribs 29 are arranged in stripes and therefore, sections of the discharge space 30 corresponding to the respective columns are each continuous in a column direction across all the lines L. For this reason, the inter-electrode spacing (reverse slit) between adjacent lines L is selected to be a value (for example, a value within the range of 150 μm-500 μm) sufficiently larger than a surface discharge gap of each line L (for example, a value within the range of 50 μm-150 μm) to enable discharge coupling to be prevented in the column direction. In the reverse slits, a light-tight film, not shown, is provided either on the front surface or on a rear surface of the substrate 11 for the purpose of screening a non-luminous whitish fluorescent layer.

Thus, in the PDP1, the inter-electrode spacing where no discharge is generated (reverse slit) is larger than the surface discharge gap where discharge is generated (referred to as a discharge slit or silt merely), so as to limit generation of discharge.

Figure 2:
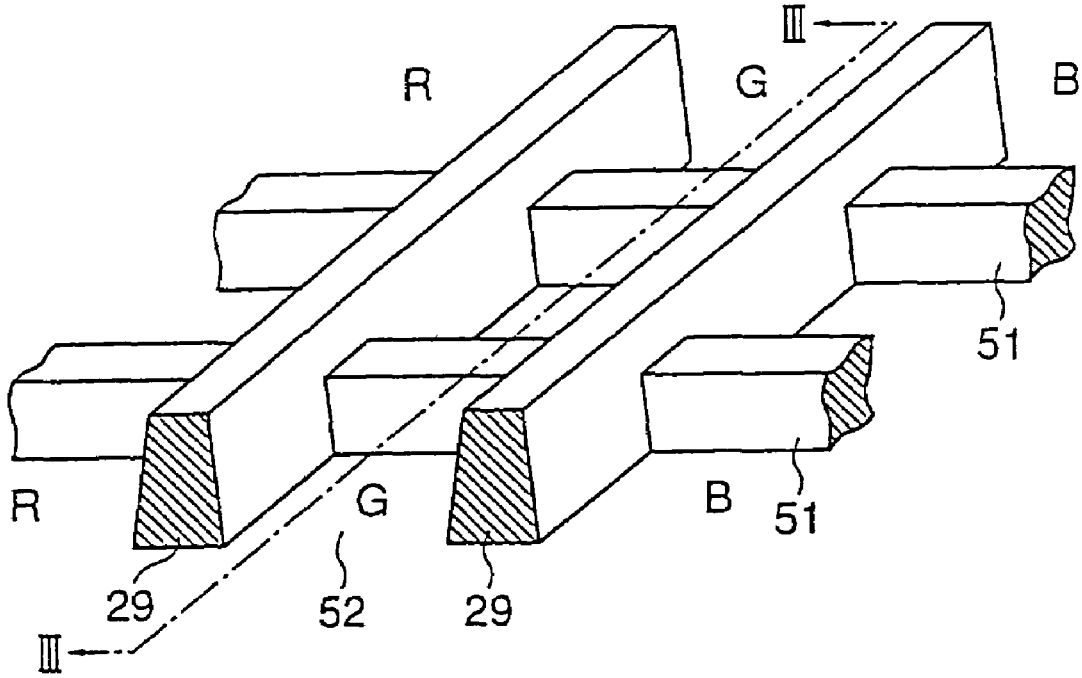
FIG. 2 is an explanatory view illustrating a first embodiment of the detailed structure of the ribs and the wall-like projections according to the present invention.

FIG. 2 is an explanatory view illustrating a first embodiment of the detailed structure of the ribs and the wall-like projections.

In this embodiment, wall-like projections 51 which are lower than the ribs 29 are continuously formed in the line direction L in locations on the rear substrate 21 corresponding to the reverse slits of the front substrate 11. The fluorescent layers 28R, 28G and 28B are formed on the entire grooves 52 between the ribs 29 by a known technique such as a screen printing method, a dispensing method and a photolithographic method (using photosensitive fluorescent substances).

Figure 3:
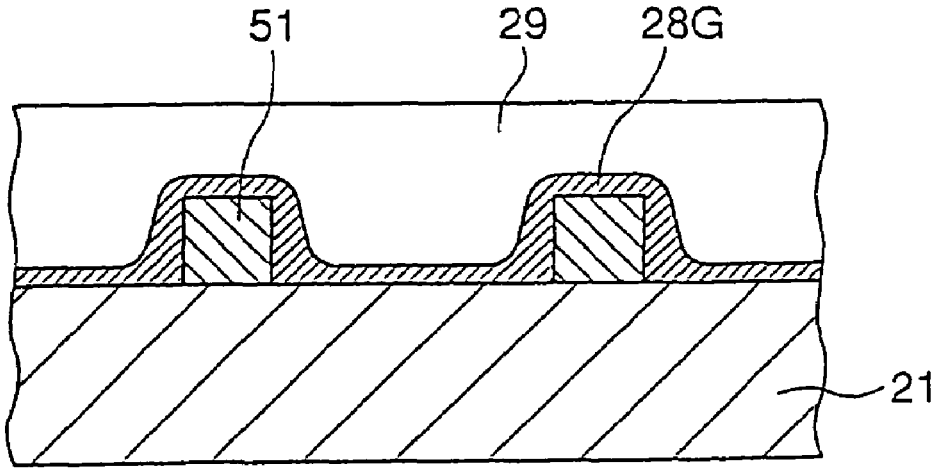
FIG. 3 is an explanatory view illustrating a cross-section taken on line III-III of FIG. 2 after the formation of the fluorescent layers.

FIG. 3 is an explanatory view illustrating a cross-section taken on line III-III of FIG. 2 after the formation of the fluorescent layers. As shown in the drawing, the fluorescent layers 28R, 28G and 28B are provided to cover the surface of the dielectric layer, side surfaces of the ribs 29 and the surfaces of the projections 51. In this case, the fluorescent layers on the surfaces of the projections 51 are made lower than the ribs 29 so as not to prevent a gas from circulating in the grooves between the ribs 29.

Thus, the fluorescent layers are also formed on the wall-like projections provided in the locations on the rear substrate 21 corresponding to the reverse slits. This leads to increase of the area coated with the fluorescent substances and therefore, increase of the luminescent area of the fluorescent substance per unit discharge area. Thus, luminance can be enhanced as compared with a conventional PDP where no projections are provided. Here, if the surfaces of the projections are coated with a light-reflective layer of a white color to reflect light emitted from the fluorescent substances or if the projections themselves are formed of a glass material containing a white pigment, the light emitted from the fluorescent substances can be reflected toward a viewer, and the luminance can be further increased.

Also, the projections 51 physically restrains discharge coupling from occurring in the column direction, so that the PDP is given a structure contributing to prevention of cross-talk in the reverse slits. Further, this cross-talk prevention structure allows the reverse slits to be narrower than in conventional PDP's and therefore, increased display discharge regions (widened slits) are achieved, which results in further enhanced luminance.

The projections 51, which are lower than the ribs 29 as mentioned above, do not prevent gases from passing during release of impurity gas or during introduction of disharge gas even if the projections 51 are coated with the fluorescent substances.

Next, in a second embodiment, the wall-like projections 51 having completely the same configuration as in the first embodiment are formed in locations in the rear substrate 21 other than the locations corresponding to the revere slits. The wall-like projections 51 are formed, for example, not in the locations corresponding to the reverse slits but in locations corresponding to the slits.

In this constitution, the projections 51 exist at the centers of the cells, and the area coated with the fluorescent substances is increased. Therefore, increase of luminance can be achieved as in the first embodiment. However, there is no effect of prevention of cross-talk in the reverse slits.

Figure 4:
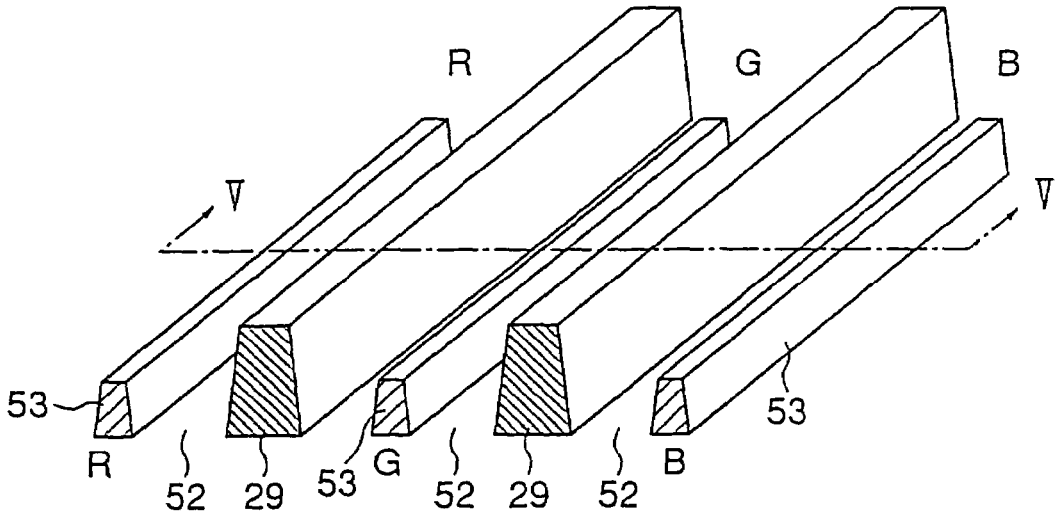
FIG. 4 is an explanatory view illustrating a third embodiment of the detailed structure of the ribs and the wall-like projections according to the present invention.

FIG. 4 is an explanatory view illustrating a third embodiment of the detailed structure of the ribs and the wall-like projections.

In this embodiment, wall-like projections 53 which are lower than the ribs 29 are formed continuously and parallel to the ribs 29 in the grooves between the ribs on the rear substrate 21. The fluorescent layers 28R, 28G and 28B are formed on the entire grooves 52 between the ribs including the projections 53.

Figure 5:
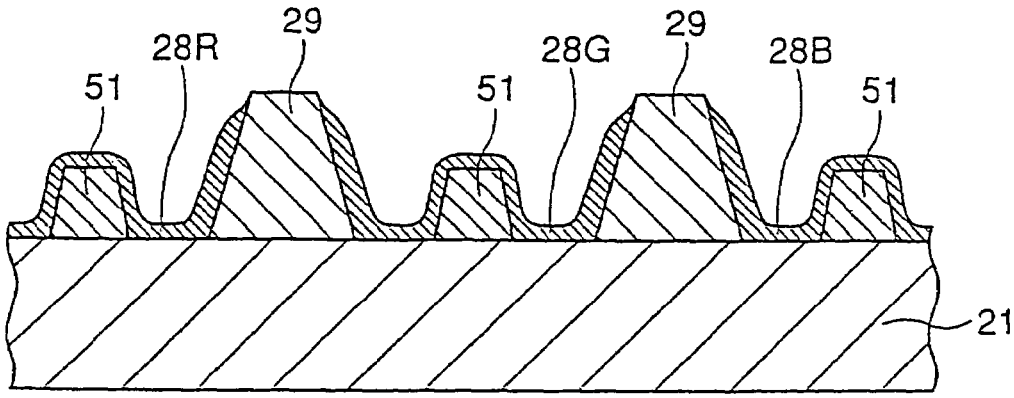
FIG. 5 is an explanatory view illustrating a cross-section taken on line V-V of FIG. 4 after the formation of the fluorescent layers.

FIG. 5 is an explanatory view illustrating a cross-section taken on line V-V of FIG. 4. As shown in the drawing, the fluorescent layers 28R, 28G and 28B are provided to cover the surface of the dielectric layer, the side surfaces of the ribs 29 and the surfaces of the projections 51.

In this constitution as well, the area coated with the fluorescent substances is increased and therefore, the luminance is enhanced as compared to a PDP where no projections are provided.

Next, in a fourth embodiment, the wall-like projections 53 having completely the same configuration as in the third embodiment are divided on a cell-by-cell basis. Division may be made in the locations corresponding to the reverse slits or in the locations corresponding to the slits. The area coated with the fluorescent substances is increased irrespective of where the division is made and therefore, the luminance is enhanced no matter where the division is made.

Figure 6:
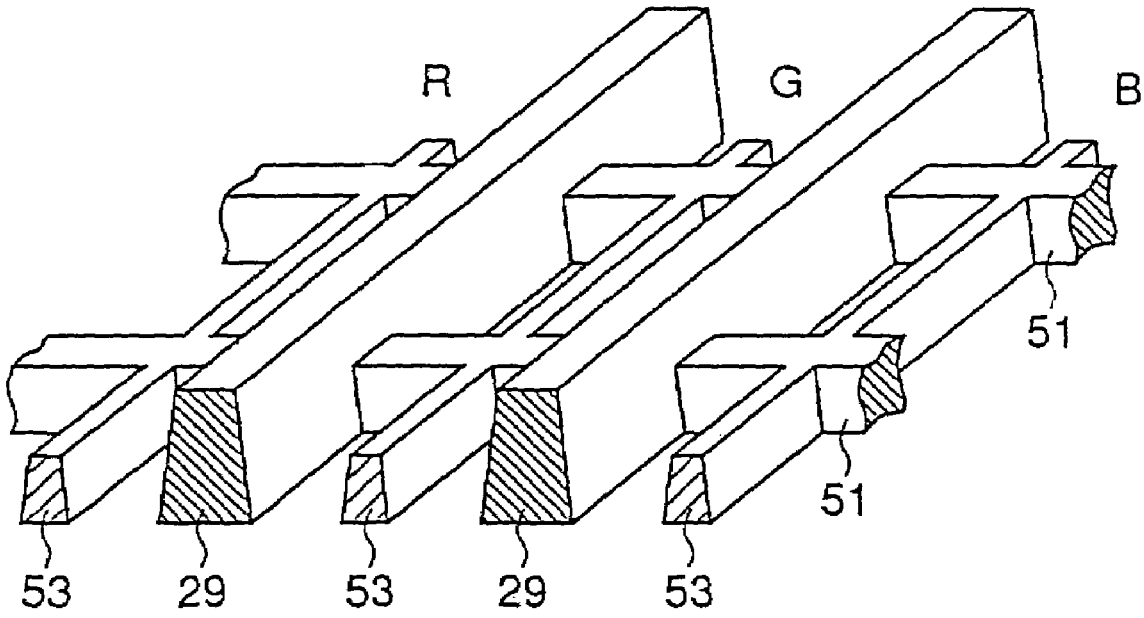
FIG. 6 is an explanatory view illustrating a fifth embodiment of the detailed structure of the ribs and the projections according to the present invention.
Figure 7A:
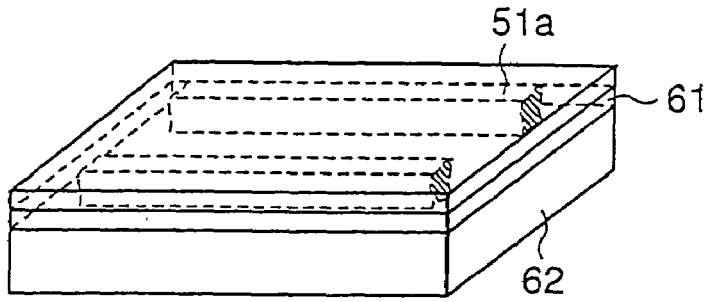
FIGS. 7(*a*) to (*d*) are explanatory views illustrating a first embodiment of the method of forming the wall-like projections and ribs shown in FIG. 2.
Figure 7B:
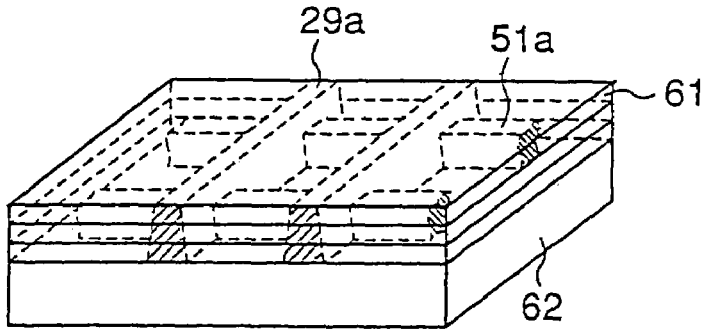
Figure 7C:
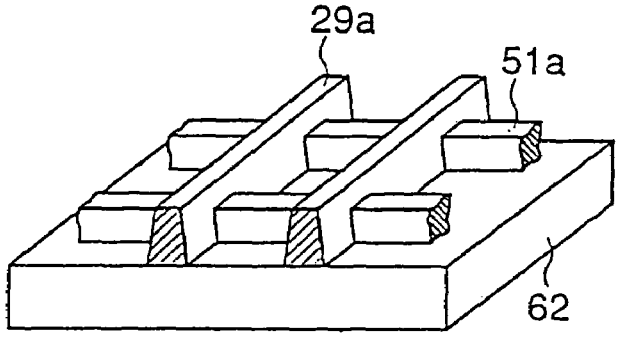
Figure 7D:
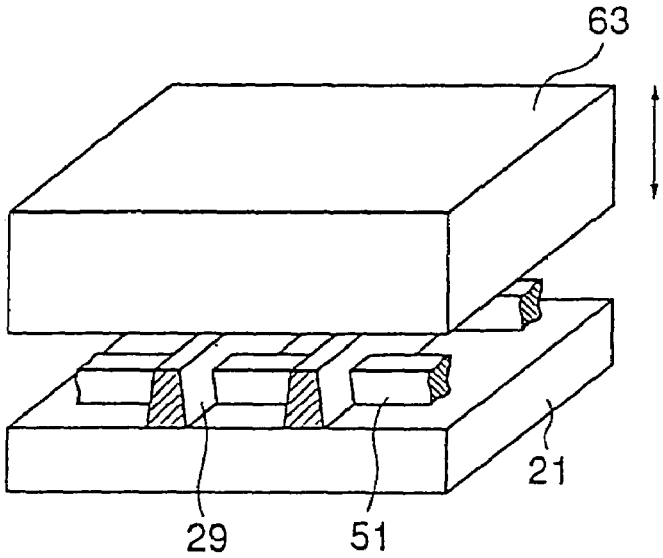
Figure 8A:
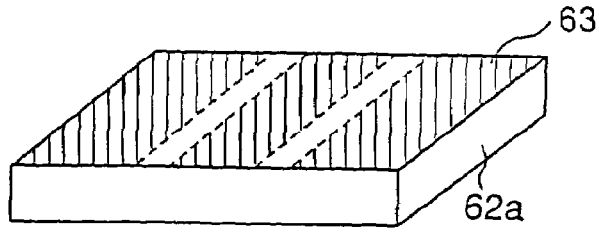
FIGS. 8(*a*) to (*e*) are explanatory views illustrating a second embodiment of the method of forming the wall-like projections and ribs shown in FIG. 2.
Figure 8B:
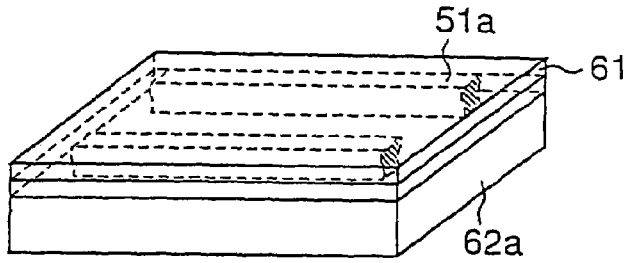
Figure 8C:
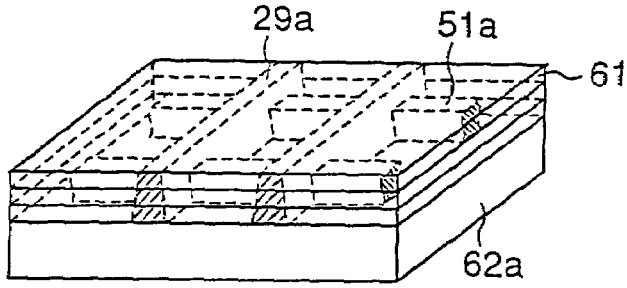
Figure 8D:
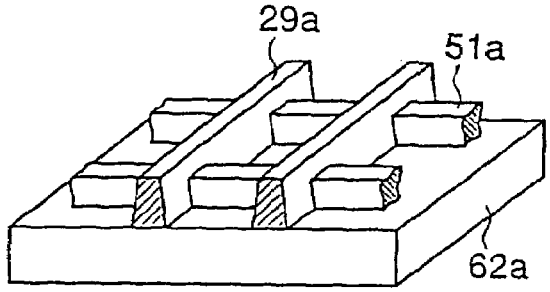
Figure 8E:
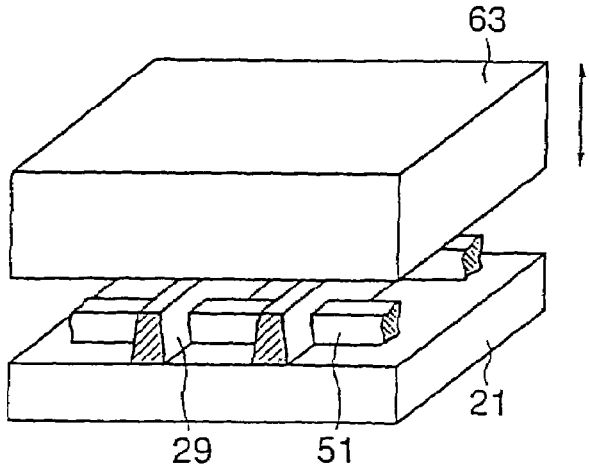
Figure 9A:
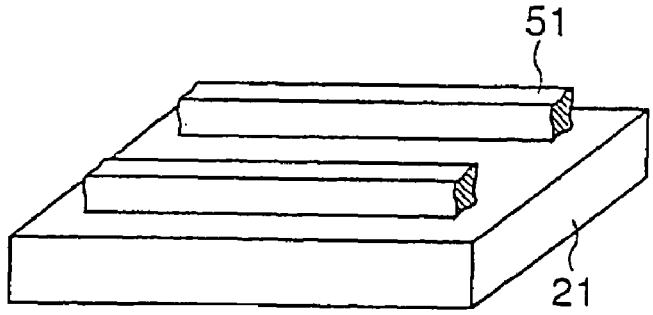
FIGS. 9(*a*) to (*d*) are explanatory views illustrating a third embodiment of the method of forming the wall-like projections and ribs shown in FIG. 2.
Figure 9B:
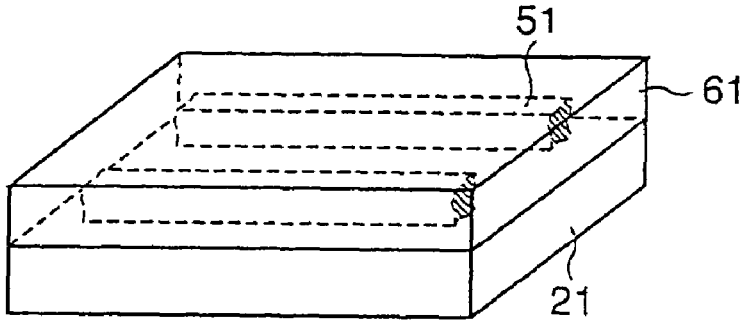
Figure 9C:
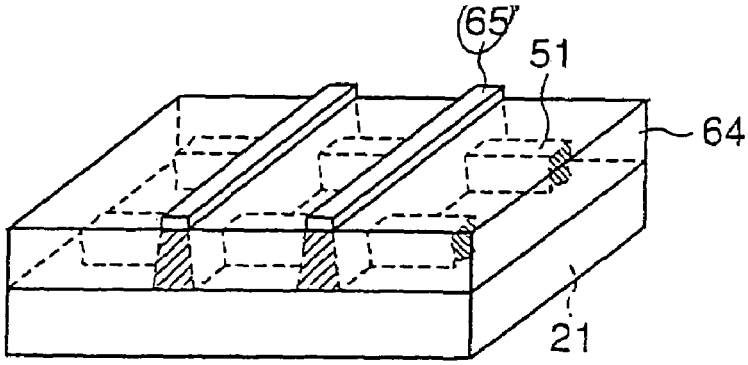
Figure 9D:
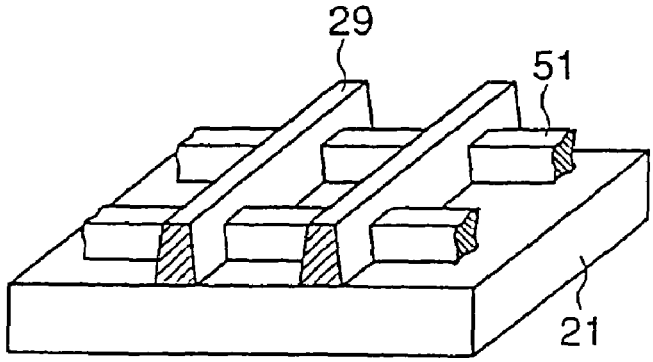

FIG. 6 is an explanatory view illustrating a fifth embodiment of the detailed structure of the ribs and the wall-like projections.

In this embodiment, the projections 51 of the first embodiment which cross the ribs 29 are combined with the projections 53 of the third embodiment which are parallel to the ribs 29. Their multiplier effect can be expected.

It is to be noted that the embodiment is not limited to this combination and optional combinations are possible. Further, more desirably, the height or the number of the ribs or the configuration in which they are combined are varied for every color of the fluorescent layers for obtaining an ideal white balance and for adjusting life.

Thus, the projections are provided in the grooves between the ribs which are regions for forming the fluorescent layers, to increase the surface area of the discharge space and thereby to increase the area coated with the fluorescent substances, which results in enhanced luminance of the PDP.

Next, a method for forming the wall-like projections and the ribs will be described.

FIGS. 7(*a*) to (*d*) are views illustrating a first embodiment of the method for forming the wall-like projections and the ribs shown in FIG. 2.

In this method, a master is fabricated with use of a photosensitive material (for example, a dry film resist, referred to as DFR hereinafter), a transfer mold is produced using the master, and the wall-like projections and the partitions are formed by a transfer method. As the photosensitive material, used is a negative type one which cures and remains when where exposed to light.

In the fabrication, a photosensitive material layer 61 (for example, two DFRs) having a height equivalent to the height of wall-like projections 51*a* is formed on a substrate 62 for a master. Then, a photolithographic mask having the pattern of the projections 51*a* is disposed thereon and the photosensitive material layer 61 is exposed via the mask (see FIG. 7(*a*)).

With this state kept without development, another new photosensitive material layer is formed thereon to a height equivalent to ribs 29*a* (for example, by overlaying another DFR thereon). Thereafter, a photolithographic mask having the pattern of the ribs 29*a* is disposed thereon and the photosensitive material layer 61 is exposed via the mask (see FIG. 7(*b*)). It is to be noted that when concaves are intended to be formed in certain portions of the pattern of the ribs, the photosensitive material only on these portions is not exposed.

Since the photosensitive materials used are of the negative type, a photopolymerization reaction takes place in portions exposed to light once or more, and the exposed portions become insoluble in a developer. Therefore, development at this stage attains the formation of a master (original) having the desired patterns of wall-like projections 51*a* and the ribs 29*a* (see FIG. 7(*c*)).

Subsequently, the projections 51*a* and the ribs 29*a* on the substrate 62 are copied using a silicone rubber or the like to produce a transfer mold 63. Then, a dielectric paste is filled into the transfer mold 63 and transferred onto the substrate 21 for a PDP to obtain desired projections 51 and ribs 29 (see FIG. 7(*d*)).

Alternatively, the transfer mold 63 may be produced of a rigid resin or by electroforming and used as a pressing mold to be pressed against a dielectric material to obtain the desired projections 51 and ribs 29. It is to be noted that the substrate formed of the photosensitive materials may be used as a master as it is or may be used as an intermediate for repeated transfer with other resins or for production of a mold by electroforming.

FIGS. 8(*a*) to (*e*) are explanatory views illustrating a second embodiment of the method for forming the wall-like projections and the ribs shown in FIG. 2.

In this embodiment, which is similar to the first embodiment of the formation method, enhanced stability in production can be attained. In the photosensitive material, light exposure allows a photopolymerization to progress, but naturally light attenuation takes place in a film thickness direction. When exposure is started with portions to be tops of ribs as in the above-mentioned first embodiment of the formation method, the strength of light is weakened most at portions in contact with the substrate 62. Accordingly, the adhesion between the photosensitive material 61 and the substrate 62 tends to increase or the ribs tend to have reverse tapers.

In the fabrication method, therefore, first, a transparent substrate 62*a* such as a glass substrate is employed as a substrate for the master. A negative pattern of the ribs is previously formed of the light-tight material (for example, a chrome thin film) 63 on the substrate 62*a* (see FIG. 8(*a*)). Thereafter, the photosensitive material layer (for example, of two DFRs) 61 having the height equivalent to projections 51*a* is formed on the substrate. Then, a photolithographic mask having the pattern of the projections 51*a* is disposed thereon as in the first embodiment of the formation method and the photosensitive material layer 61 is exposed via the mask (see FIG. 8(*b*)).

Subsequently, in this state without development, another new photosensitive material layer 61 is formed to a height equivalent to ribs 29*a* (for example, by overlaying another DFR). Then, for exposure for the pattern of the ribs 29*a*, without using a photolithographic mask, the photosensitive material layer 61 is exposed from the rear surface of the transparent glass substrate 62*a* via the mask of the light-tight material 63 previously formed on the substrate 62*a* (see FIG. 8(*c*)), followed by development. Thus, a master is obtained which has the desired pattern of the projections 51*a* and the ribs 29*a* (see FIG. 8(*d*)).

Using this mater, the transfer mold 63 is produced, a dielectric paste is filled into the transfer mold 63 and transferred onto the substrate 21 of the PDP to obtain the desired projections 51 and the ribs 29, as in the first embodiment of the formation method (see FIG. 8(*e*)). Alternatively, a pressing mold may be produced using the master and pressed against a dielectric material to obtain the desired projections 51 and ribs 29.

Thus, the photosensitive material layer 61 is exposed from the rear surface in the second exposure so that the strongest light is applied to portions of the photosensitive material layer 61 to be the ribs which portions are in contact with the substrate 62*a*. Thereby, the photopolymerization is accelerated in the contact portions, and the photosensitive material layer becomes less susceptible to the developer. As a result, the adhesion is drastically enhanced between the photosensitive material 61 and the substrate 62*a*. Further, by the effect of light attenuation, light becomes weaker as it travels toward the tops of the ribs to give the ribs mountain-like tapers. A transfer mold fabricated using this master has an excellent so-called removal property, which allows the rib material filled into concaves to be easily released during transfer. That ensures stability in production of plasma display panels.

The reason why, in this embodiment, the second exposure is performed from the rear surface of the substrate is that the projections 51 are low in profile and easily transferred (has a high transfer probability) and therefore need not always be tapered. Also, since the ribs are formed to cross the projections from above, the enhanced adhesion of the ribs to the substrate automatically ensures the adhesion of the projections located below the ribs to the substrate. However, rear-surface exposure may be performed prior to front-surface exposure or vice versa, and this order is determined depending on a process and desired configuration.

In the first embodiment and the second embodiment of the formation method, the master is produced by so-called multi-stage exposure where: the first photosensitive material layer is formed on the substrate and exposed; without development, the second photosensitive material layer is formed thereon and exposed from the front surface or from the rear surface; and the first and second photosensitive material layer are developed at once. Thereafter, using the master, the projections and ribs are formed by the transfer method or the pressing method.

The technique of multi-stage exposure, therefore, makes it possible to form on the same substrate the projections and ribs different in height, and easily and precisely to fabricate a master having a minute configuration which has been difficult to produce by machining.

In other words, the master to be employed in the method of forming the ribs by transfer (including the pressing method), which is an economical and simple method for producing the ribs, can be fabricated in a good yield and with ease. Also, control of a taper angle of the rib and fabrication of the pattern such as a lattice pattern are easily attained, which have been extremely difficult by machining. Further, since the pattern is formed basically by photolithography, its design can be easily modified.

In the first and second embodiment of the formation method, the projections and ribs are formed by the transfer method or the pressing method. However, they may be formed of a photosensitive rib material directly on a substrate for a PDP.

That is, instead of the substrate 62 or the transparent substrate 62*a*, the rear glass substrate 21 for a PDP may be used on which the address electrodes are formed. A photosensitive rib material may be used instead of a photosensitive material such as a DFR to form the projections 51 and ribs 29 directly on the rear glass substrate 21 by the same method as in the first and second embodiment of the formation method.

In the case where the rear-surface exposure as explained in the second embodiment of the formation method is used for the direct formation of the projections 51 and the ribs 29 on the rear substrate, if the electrode pattern of the address electrodes A may be utilized as it is as a pattern of the light-tight material, the need is eliminated for aligning a masking pattern of the ribs with the address electrodes A.

FIGS. 9(*a*) to (*d*) are explanatory views illustrating a third embodiment of the method for forming the wall-like projections and the ribs shown in FIG. 2.

In this embodiment, the wall-like projections and the ribs are formed directly on the substrate for a PDP without using the transfer method or the pressing method.

In this embodiment, the rear glass substrate 21 is employed which has the underlying layer 22, the address electrodes A and the dielectric layer 24 formed on the upper surface. The wall-like projections 51 are formed of a first material (a rib material or a similar material to the rib material) by a known method (a repeated screen printing method, a sandblastinging method, an additive method, the photolithographic method, the transfer method)(see FIG. 9(*a*)). The projections 51 need to be sandblast-resistant.

Thereafter, a rib material layer (uniform film) 64 is formed of a second material on the substrate 21 (see FIG. 9(*b*)). Then, a masking pattern 65 of the ribs 29 is formed of a sandblast-resistant material on the surface of the rib material layer 64 by, for example, a photolithographic technique (see FIG. 9(*c*)). Subsequently, the rib material layer is sandblasted to form the ribs 29. The wall-like projections 51 remain as they are because they are sandblast-resistant. Thus, the wall-like projections 51 and the ribs 29 are formed (see FIG. 9(*d*)).

In this embodiment, since the ribs 29 are formed by sandblasting, it is necessary that the projections 51 should not be sandblasted. For this reason, the projections 51 need to be given a differentiated sandblasting rate before hand by firing and vitrifying them to enhance its mechanical strength, or by increasing a resin content (binder amount) in the material (first material) for forming the projections 51 as compared with the second material subsequently used.

A rib material most frequently employed is typically a glass paste containing PbO. This glass paste is prepared by mixing glass powder of PbO, a filler (aggregate) of a refractory oxide (refractory up to about 1500° C.) such as $SiO_2$ or $Al_2O_3$, a binder resin such as an acrylic resin or a cellulose resin, and a solvent such as telpineol or Butyl Carbitol.

The formation of the ribs is performed by applying the glass paste and drying the glass paste to vaporize the solvent component; then sandblasting the resulting glass paste to form the ribs; and then firing the glass paste to burn off the binder resin component so that only the filler and the glass component solidified around the filler remain. The glass paste has a nature that it is difficult to sandblast when it contains a large amount of the binder resin component while it is easy to sandblast when it contains a small amount of the binder resin component. Accordingly, this nature can be utilized for providing different sandblasting rates.

Next, described is a modified embodiment of the third embodiment of the formation method.

Typically, the glass paste is contracted by about 70% to about 80% when it converts from a paste state to the solidified ribs. Accordingly, this nature can be utilized for forming the wall-like projections lower than the ribs.

The rear glass substrate 21 is employed which has the underlying layer 22, the address electrodes A and the dielectric layer 24 formed on its upper surface. First the ribs 29 are formed of a first material (a rib material) on the substrate 21 by a known method (the repeated screen printing method, the sandblasting method, the additive method, the photolithographic method, the transfer method), followed by firing.

Thereafter, a second material (the rib material or a similar material to the rib material) is applied to gaps between the ribs to the same height as the post-firing height of the ribs 29, and dried. Then, a masking pattern of the projections 51 is formed of a sandblast-resistant material on the surface of the layer of the second material by, for example, the photolithographic technique, followed by sandblasting. Thus, the projections 51 are formed, followed by firing. Since the ribs 29 have already been fired, only the projections 51 are contracted at this firing stage. Thus, there are formed the ribs 29 and the wall-like projections 51 which are about 70% to about 80% as high as the ribs.

Here, the above-mentioned glass paste has a relationship such that it contracts less during firing when it contains more filler (contraction rate during firing→small) while it contracts more when it contains less filler (contraction rate during firing→large). Also, there is another relationship such that the glass paste contracts less during firing when it contains less binder resin while it contracts more when it contains more binder resin. Accordingly, by using these relationships and suitably adjusting the amounts of the filler and the binder resin, the projections 51 can be made about 40% to 50% as high as the ribs 29 at the maximum.

In this modified embodiment, the projections having a predetermined height can be constantly obtained by the simple step of applying the glass paste to the same height as the ribs for forming the ribs. The contraction rate, however, has its limitation, and it is necessary to set the contraction rate as a yardstick, in order to determine which of the projections or the ribs should be formed first. In other words, if low projections are intended to be formed, the projections should be formed first, while if high projections are intended to be formed, the ribs should be formed first.

Figure 10A:
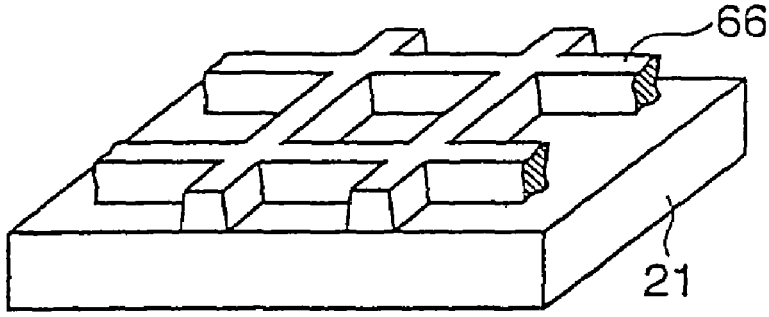
FIGS. 10(*a*) and (*b*) are explanatory views illustrating a fourth embodiment of the method of forming the wall-like projections and ribs shown in FIG. 2.
Figure 10B:
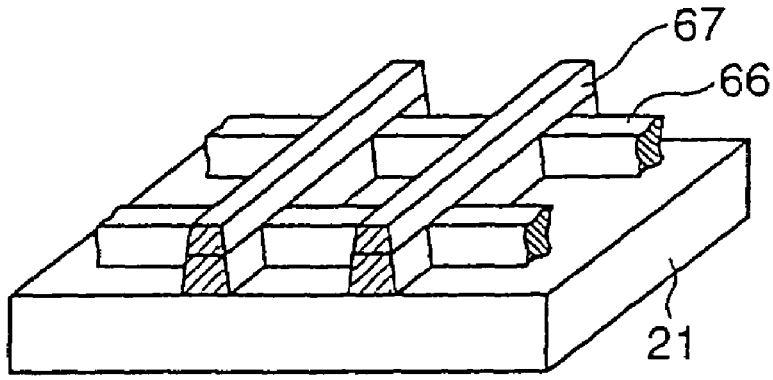

FIGS. 10(*a*) to (*b*) are explanatory views illustrating a fourth embodiment of the method for forming the wall-like projections and the ribs shown in FIG. 2.

In this embodiment as well, the projections and the ribs are formed directly on the substrate for a PDP without using the transfer method and the pressing method.

In this embodiment, as in the third embodiment of the formation method, the rear glass substrate 21 is employed which has the underlying layer 22, the address electrodes A and the dielectric layer 24 formed on its upper surface. Then, on this substrate 21, formed is a pattern with a lattice-like convex 66 in which the projections and the ribs are connected to each other and which has the height of the projections, by a known method (the repeated screen printing method, the sandblasting method, the additive method, the photolithographic method, the transfer method or the like) (see FIG. 10(*a*)).

Subsequently, a layer 67 of a rib material paste is formed only on portions corresponding to the ribs, by the repeated screen printing method. Thus, the wall-like projections 51 and the ribs 29 are formed. The portions of the convex 66 where the paste layer 67 laminated come to be the ribs 29 and the other portions of the convex 66 where the paste layer 67 not laminated come to be the wall-like projections 51 (see FIG. 10(*b*)).

Alternatively, the desired projections 51 and the ribs 29 may be formed by forming the lattice-like convex 66, forming on the entire surface a rib material layer easy to sandblast, and forming a masking pattern of the ribs, followed by sandblasting, or alternatively by forming the lattice-like convex, forming a photosensitive rib material on the entire surface, and forming the pattern of the ribs by the photolithographic method.

The above explanations of the formation methods were given only on how the projections and the ribs in the configurations of the first embodiment and the second embodiment shown in FIG. 2 are formed, but the same formation methods can be applied to the projections and the ribs in the configurations of the third embodiment and the fourth embodiment shown in FIG. 4 and of the fifth embodiment shown in FIG. 6.

Thus, since the coating amount of the fluorescent substances can be increased by forming the wall-like projections which are lower than the ribs, in the elongated grooves between the ribs, the luminance of the panel can be enhanced. Further, the above-mentioned production methods make it possible to produce a plasma display panel having enhanced luminance by using conventional production facilities and adding simple modifications to conventional production methods. Therefore, the methods are industrially applicable in general. Further, the use of the transfer method or the pressing method which employs the master of a photosensitive material makes it possible to produce a plasma display panel by a simpler, cost-saving process in a good yield.

Although the above explanations were given of the embodiments where the projections are formed of the rib material or a material similar to the rib material, the projections may be formed not only of the same material as the rib material but of various materials.

Next, explanations will be made of embodiments where the projections are formed of different materials from the rib material such as the same material as that of the fluorescent layers, the same material as that of the dielectric layer, a white pigment used for coloring the ribs or the like white, or the like. It is to be noted that although in the following embodiments, the projections are formed in the locations corresponding to the reverse slits, the projections may be formed, as described in the second embodiment showing the detailed construction of the ribs and the projections, in other locations on the rear substrate than the locations corresponding to the reverse slits, for example, in the locations corresponding to the slits. In this case, the same effect as in the second embodiment can be obtained.

Figure 11:
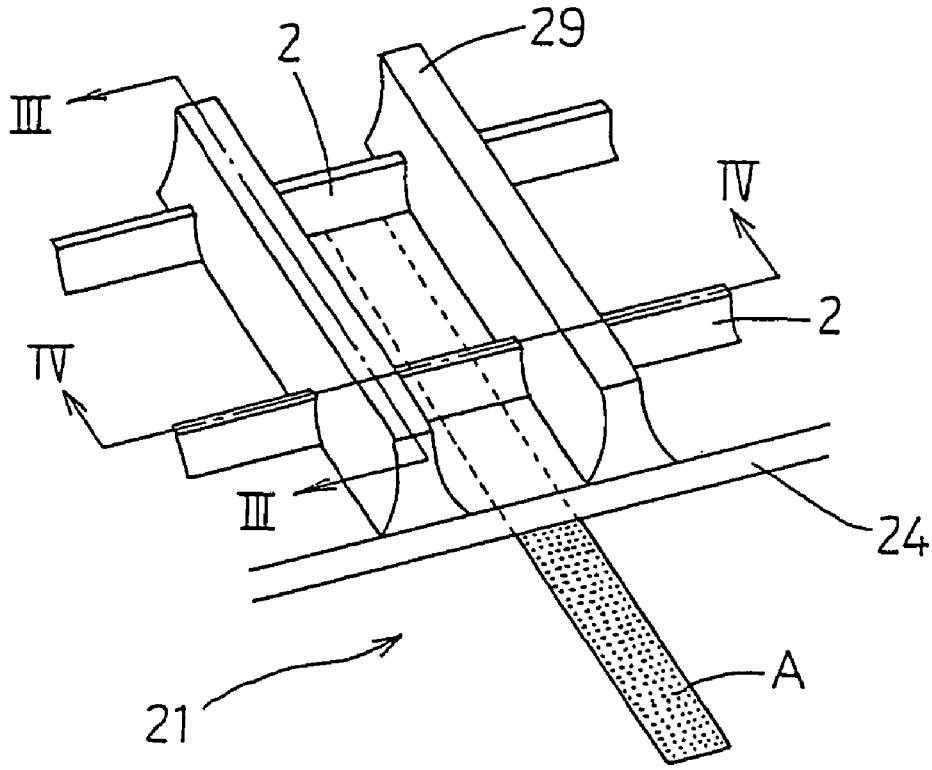
FIG. 11 is a perspective view illustrating the details of a part of a rear substrate on which the projections are formed of a material different from a material of the ribs.

FIG. 11 is a perspective view illustrating the details of a part of the rear substrate 21 on which the projections are formed of a material different from the rib material.

As shown in this drawing, the PDP of this embodiment is constructed such that projections 2 are provided on the rear substrate 21 in a direction crossing the ribs 29. The projections 2 are provided in boundary areas between discharge cells (discharge regions) in elongated grooves between the ribs 29 i.e., in the locations corresponding to the reverse slits which lie halfway between pairs of sustain electrodes X and Y. The projections 2 are lower than the ribs but high enough to prevent discharge coupling between the discharge cells.

The projections 2 are formed of the same materials as that of the fluorescent layers 28R, 28G and 28B, the same material of the dielectric layer 24, or the like. Alternatively, the white pigment or others used for whitening the ribs or the like may be used. The same material as the rib material can be used as a matter of course. In this embodiment, the projections are formed of a $PbO—B_2O_3—SiO_2$-containing glass.

The projections 2 are formed lower than the ribs 29 not to prevent gases from circulating between the ribs during discharge of impurity gases which are generated in the course of the production of the panel, or during introduction of the discharge gas. In this embodiment, the projections 2 has about half the height of the ribs 29.

Thus, the projections 2 which are lower than the ribs 29 are formed on the rear substrate 21 in the locations corresponding to the revere slits, thereby preventing discharge from diffusing in adjacent cells.

This allows discharge coupling to be physically prevented in the direction crossing the ribs 29, i.e., between discharge cells adjacent in the longitudinal (lengthwise) direction of the ribs 29. Accordingly, quality of display can be improved as compared with that of the conventional PDP. Further, the inter-electrode spacing (reverse silt) between adjacent lines can be narrower than that of the conventional PDP. Accordingly, the display discharge region (inter-slit spacing) is enlarged for improvement of luminance. Or, image density can be increased to provide a high-definition screen.

The fluorescent layers 28R, 28G and 28B may be formed in the grooves between the ribs 29 to cover the surface of the dielectric layer 24, the side surfaces of the ribs 29 and surfaces of the ribs 2 by applying and firing a fluorescent substance paste using a known technique such as a dispensing method and the screen printing method.

In the case where the fluorescent layers are formed to cover the whole projections 2 in the grooves between the ribs 29, the area coated with the fluorescent substances is increased and therefore the fluorescent luminescent area per unit discharge area is increased. This results in enhanced luminance as compared with that of the conventional PDP where no projections are provided.

Since the height of the projections 2 is about half the height of the ribs 29, the gases are not prevented from circulating during discharge of the impurity gases or during introduction of the discharge gas.

FIGS. 12(A) to (G) are explanatory views illustrating an embodiment of a method for forming the projections 2 shown in FIG. 11, in the order of steps. These drawings show cross-sections of the rear substrate 21 taken on line III-III of FIG. 11. In this embodiment of the method for fabricating a PDP, the projections 2 are formed simultaneously with the formation of the ribs 29, by sandblasting.

Figure 12A:
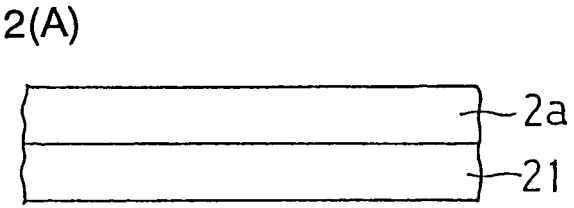
FIGS. 12(A) to (G) are explanatory views illustrating an embodiment of a method for forming the projections shown in FIG. 11, in the order of steps.

First, a material 2*a* of the projections is applied onto the entire surface of the rear surface 21 on which surface the dielectric layer 24 is formed, and dried (see FIG. 12(A)). The material 2*a* of the projections may be any having a sandblast rate about the same as that of the material of the ribs 29 in a sandblasting process described later. Accordingly, the material 2*a* of the projections may be the same as the material of the ribs 29, or it may be the same as the material of the dielectric layer 24, or it may be other than those. In this embodiment, a $PbO—B_2O_3—SiO_2$-containing glass is used. The material 2*a* of the projections is applied by a known screen printing or slot coating method, or the like.

Figure 12B:
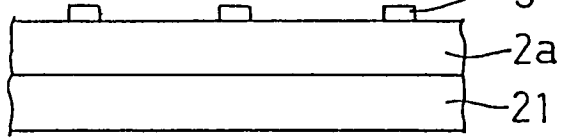

Next, a masking pattern 3 of the projections is formed on the material 2*a* of the projections (see FIG. 12(B)) by a known photolithographic technique. A material of the masking pattern 3 may be any that is formed to be rigid enough to be sandblast-resistant in the below-mentioned sandblasting process.

Figure 12C:
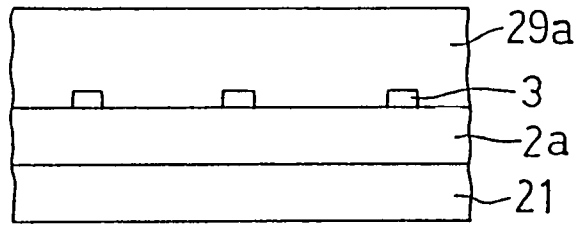

Thereafter, a material 29*a* of the ribs is applied onto the whole surface of the masking pattern 3 and dried (see FIG. 12(C)). Usable as the material 29*a* of the ribs is a known material such as a mixture of a low-melting glass powder with a resin and a solvent. The application of the material 29*a* of the ribs is performed also by a known screen printing method or slot coating method, or the like.

Figure 12D:
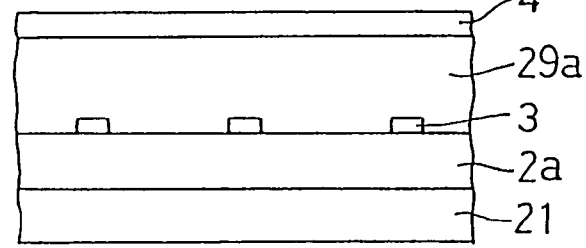

As mentioned above, a titanium oxide, a white pigment or the like may be added to the material 2*a* of the projections and to the material 29*a* of the ribs for the purpose of coloring white the projections and the ribs so as to enhance visible light reflectance Then, a masking pattern 4 of the ribs is formed on the material 29*a* (see FIG. 12(D)) by a known photolithographic technique. A material of the masking pattern 4 may also be any that is formed to be rigid enough to be sandblast-resistant in the below-mentioned sandblasting process, and may be the same as or different from the material of the masking pattern 3.

Figure 12E:
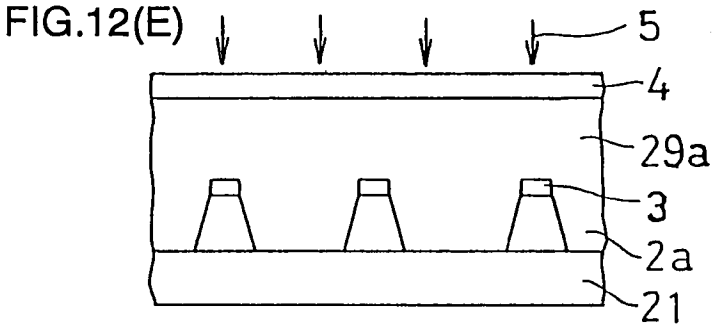
Figure 12F:
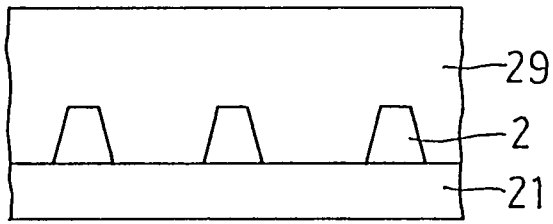

Thereafter, particles for sandblasting are blown in the direction of arrows 5 shown in the drawings to simultaneously sandblast the material 29*a* of the ribs and the material 2*a* of the projections (see FIG. 12(E)).

Next, the masking patterns 3 and 4 are stripped or removed by blowing a developer thereon, followed by firing. Thus, the projections 2 and the ribs 29 are formed (see FIG. 12(F)).

Figure 12G:
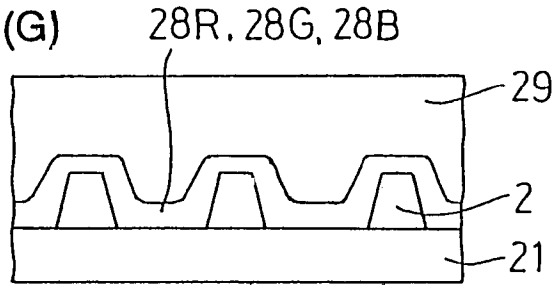

Subsequently, the fluorescent layers 28R, 28G and 28B are formed in the grooves between the ribs 29 to cover the surface of the dielectric layer 24, the side surfaces of the ribs 29 and the surface of the projections 2 by applying a fluorescent substance pastes using a known technique such as the dispensing method, the screen printing method or the like, followed by firing (see FIG. 12(G)).

Light emitted from the fluorescent substances can be visually reflected for further increase in the luminance by, prior to the formation of the fluorescent layers, coating the surfaces of the projections 2 with a white light-reflective layer which reflects the emitted light from the fluorescent substances, or by forming the projections 2 themselves of a glass material containing a white pigment as described above.

Figure 13A:
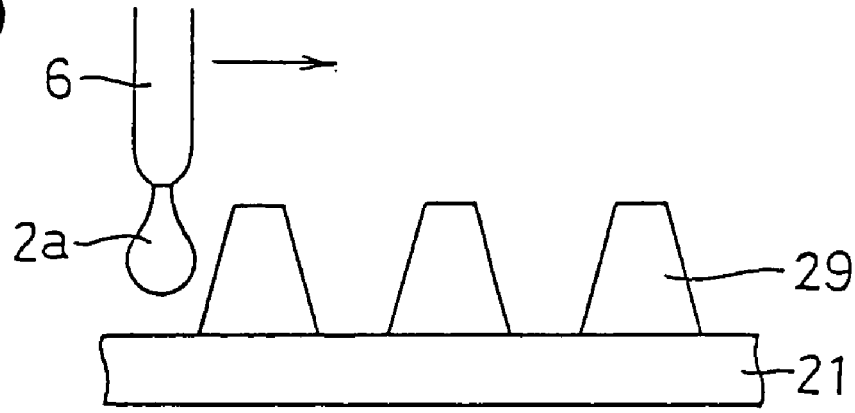
FIGS. 13(A) to (C) are explanatory views illustrating another embodiment of the method for forming the projections shown in FIG. 11, in the order of steps.
Figure 13B:
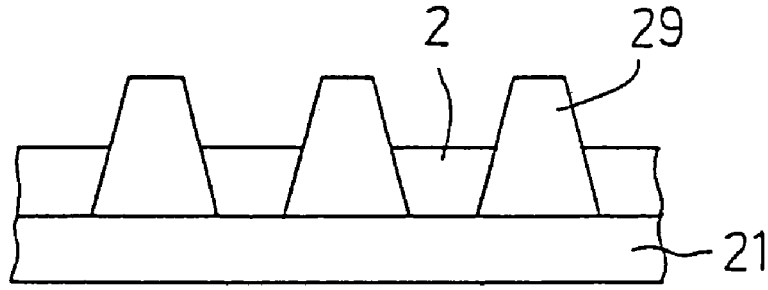
Figure 13C:
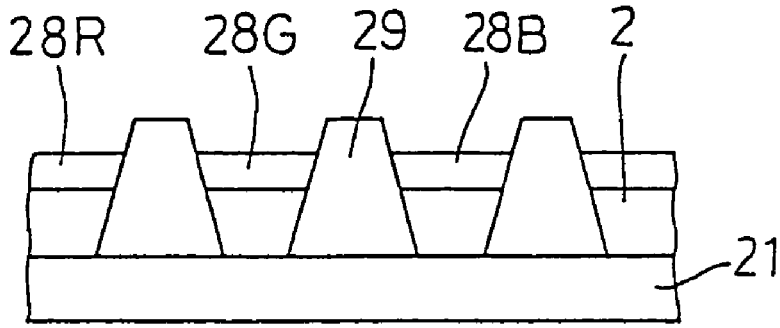

FIGS. 13(A) to (C) are explanatory views illustrating another embodiment of the method of forming the projections 2 shown in FIG. 11, in the order of steps. These drawings show cross-sections of the rear substrate 21 taken on line IV-IV of FIG. 11. In this embodiment, the projections 2 are formed by the dispensing method.

First, a paste-form material 2*a* of the projections is applied onto the rear substrate 21 on which the ribs 29 have already been formed by a known method by a dispenser 6 for coating a fluorescent substance paste. The dispenser discharges the paste-form material 2*a* of the projections from its tip and moves in the direction of an arrow shown in the drawing (see FIG. 13(A)).

Usable as the material 2*a* of the projections is fluorescent substance paste used in the formation of the fluorescent layers 28R, 28G and 28. Alternatively, a paste-form material of the ribs 29 itself or a mixture of the paste-form material of the ribs 29 with a suitable solvent may be used, or a paste-form dielectric material used for forming the dielectric layer 24 or a mixture of the paste-form dielectric material with a suitable solvent may be used. Alternatively, other materials such as a white pigment used for coloring the ribs white may be used.

Titanium oxide, a white pigment or the like may be added to the material 2*a* of the projections for the purpose of coloring the projections and the ribs white so as to enhance the visible light reflectance.

For application, the dispenser 6 may be stopped groove by groove between the ribs and discharge the material 2*a* of the projections from its tip, or the dispenser 6 may be continuously moved in the direction of the arrow shown in the drawing while discharging the material 2*a* of the projections from its tip. Even if the material 2*a* for the projections is continuously discharged, the material 2*a* of the projections put on the top portions of the ribs 29 flows down naturally in the grooves between the ribs because the material 2*a* of the projections is in the form of a paste. In this case, the material 2*a* for the projections, if it remains on the top portion of the ribs 29, is removed in a process for leveling the top portion of the ribs 29 (explanations omitted because it is a known process), which therefore raises no problems.

In the case where fluorescent substance pastes are used as the material 2*a* of the projections, the fluorescent substance pastes have the same colors as the fluorescent layers 28R, 28G and 28B. Application of the material 2*a* of the projections is repeated three times color by color, by stopping the dispenser 6 groove by groove between the ribs 29.

Next, the applied material 2*a* of the projections is dried and fired. Thus, the projections 2 are formed (see FIG. 13(B)). In the case where the fluorescent substance pastes are used as the material 2*a* of the projections, they may be only dried at this stage, and be fired simultaneously with the fluorescent layers during the step of forming the fluorescent layers.

Subsequently, the fluorescent layers 28R, 28G and 28B are formed to cover the surface of the dielectric layer 24, the side walls of the ribs 29 and the surfaces of the projections 2, by applying (filling) the fluorescent substance pastes so as to fill the fluorescent substance pastes in the elongated grooves between the ribs in stripes using a known technique such as a dispensing method or a screen printing method, and then drying and firing the fluorescent substance pastes (see FIG. 13(C)).

Figure 14A:
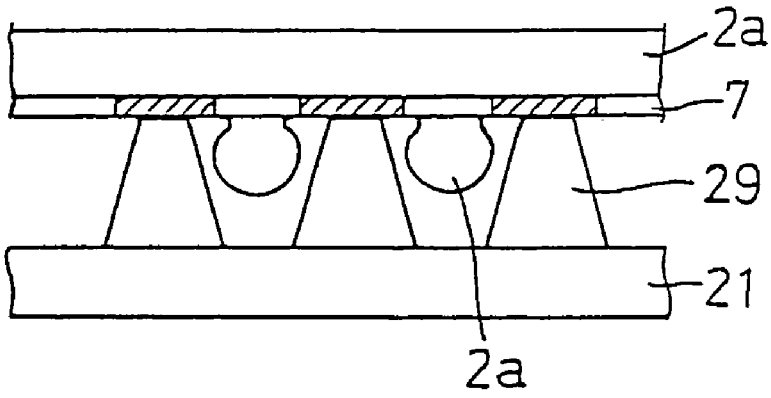
FIGS. 14(A) to (C) are explanatory views illustrating still another embodiment of the method for forming the projections shown in FIG. 11.
Figure 14B:
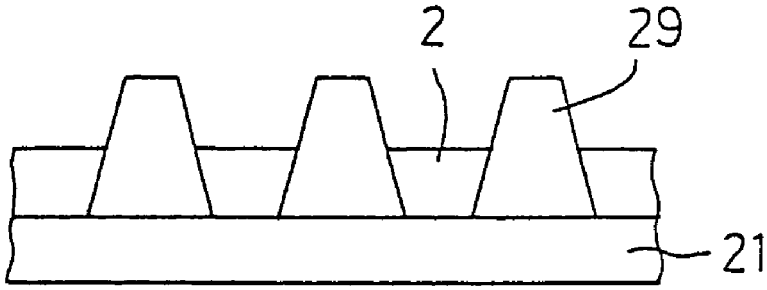
Figure 14C:
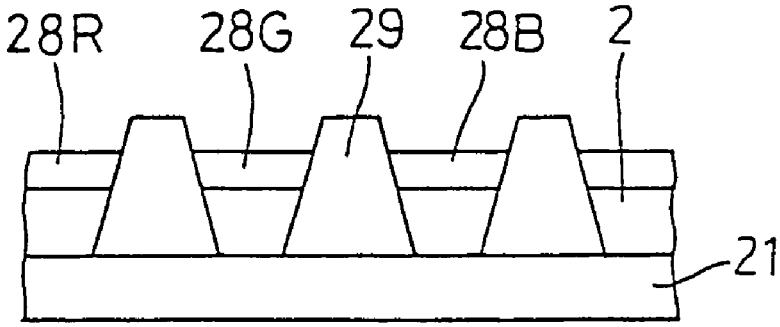

FIGS. 14(A) to (C) are explanatory views illustrating still another embodiment of the method for forming the projections 2 shown in FIG. 11. These drawings as well as FIGS. 13(A) to (C) show cross-sections of the rear substrate 21 taken on line IV-IV of FIG. 11. In this embodiment, the projections 2 are formed by the screen printing method.

First, a screen 7 is disposed in position on the rear substrate 21 on which the ribs 29 have already been formed by a known method. The screen was produced so as to allow the material 2*a* of the projections to pass only at predetermined sites in the screen. The material 2*a* of the projections is then printed via the screen 7 (see FIG. 14(A)).

In this case as well, usable as the material 2*a* of the projections are fluorescent substance pastes, the paste-form material of the ribs 29, the mixture of the material of the ribs 29 with a suitable solvent, the paste-form dielectric material, a mixture of the paste-form dielectric material with a suitable solvent, or a white pigment or the like, as in the aforesaid dispensing method. Further, as mentioned above, titanium oxide, a white pigment or the like may be added to the projection material 2*a* for the purpose of coloring the projections white so as to enhance the visible light reflectance.

In the case where fluorescent substance pastes are used as the material 2*a* of the projections, the fluorescent substance pastes having the same colors as those of the fluorescent layers 28R, 28G and 28B are used. Application of the material 2*a* of the projections is repeated three times color by color.

Next, the applied material 2*a* of the projections is dried and fired. Thus, the projections 2 are formed (see FIG. 14(B)). In the case where the fluorescent substance pastes are used as the material 2*a* of the projections, they may be only dried at this stage, and be fired simultaneously with the fluorescent layers during the step of forming the fluorescent layers.

Subsequently, the fluorescent layers 28R, 28G and 28B are formed to cover the surface of the dielectric layer 24, the side surfaces of the ribs 29 and the surfaces of the projections 2, by applying the fluorescent substance pastes so as to fill the fluorescent substance pastes in the elongated grooves between the ribs using a known technique such as the dispensing method or screen printing method, and then drying and firing the fluorescent substance pastes (see FIG. 14(C)).

Thus, the projections which are lower than the ribs are formed of a material identical with or different from that of the ribs, in boundary areas between the discharge cells formed in the grooves between the ribs in stripes, so that the interference of discharge is prevented between adjacent discharge cells in the grooves and also, discharge light is inhibited from diffusing, thereby improving the luminous efficiency.

The invention claimed is:

1. A method for forming a rib pattern, having rib portions of relatively lower and higher heights, on a substrate of a plasma display panel, the method comprising:

forming a first photosensitive rib material layer, having a thickness corresponding to the height of the lower height rib portions, on the substrate, the lower height rib portions corresponding to rib portions extending in a first direction;

disposing thereon a first photolithographic mask having a pattern defining the lower height rib portions, followed by exposure;

without development, superimposing on the first photosensitive rib material layer a second photosensitive rib material layer, a combined thickness of the first and second photosensitive rib material layers being substantially equal to the height of the higher height rib portions, the higher height rib portions corresponding to rib portions extending in a second direction, perpendicular to the first direction;

disposing on the second photosensitive rib material layer a second photolithographic mask having a pattern defining the higher height rib portions, followed by exposure; and developing by removing the first and second photosensitive rib material layers, except for the lower and higher height rib portions defined respectively by the exposure with said photolithographic masks.

2. The method for forming a rib pattern as claimed in claim 1, wherein the developing of the first and second photosensitive rib material layers is a single process.

3. The method for forming a rib pattern as claimed in claim 1, wherein the lower height rib portions correspond to rib portions extending in a horizontal direction and the higher height rib portions correspond to rib portions extending in a vertical direction.

4. The method for forming a rib pattern as claimed in claim 1, wherein the first photosensitive rib material layer, having a thickness corresponding to the height of the lower height rib portions, is comprised of a plurality of photosensitive rib material layers, and the plurality of photosensitive rib material layers comprising the first photosensitive rib material layer are exposed simultaneously.

5. The method for forming a rib pattern as claimed in claim 4, wherein the second photosensitive rib material layer, having a thickness corresponding to the height of the higher height rib portions, is comprised of a plurality of photosensitive rib material layers, and the plurality of photosensitive rib material layers comprising the second photosensitive rib material layer are exposed simultaneously.

6. The method for forming a rib pattern as claimed in claim 5, wherein the second photosensitive rib material layer is exposed from a rear surface side of the substrate.

7. The method for forming a rib pattern as claimed in claim 1, wherein the second photosensitive rib material layer is exposed from a rear surface side of the substrate.

* * * * *

UNITED STATES PATENT AND TRADEMARK OFFICE

CERTIFICATE OF CORRECTION

PATENT NO. : 7,371,508 B2
APPLICATION NO. : 10/810661
DATED : May 13, 2008
INVENTOR(S) : Osamu Toyoda et al.

It is certified that error appears in the above-identified patent and that said Letters Patent is hereby corrected as shown below:

Title Page, item [63] Column 1 (Related U.S. Application Data), Lines 1-3, change "Continuation of application No. 09/763,572, filed as application No. PCT/JP99/04141 on Jul. 30, 1999, now Pat. No. 6,713,959." to --Continuation of application no. 09/763,572, filed on Feb. 26, 2001, now Pat. No. 6,713,959, which was filed as a national stage of PCT/JP99/04141 filed on Jul. 30, 1999.--.

Signed and Sealed this

Twenty-third Day of September, 2008

JON W. DUDAS
*Director of the United States Patent and Trademark Office*